US006132556A

United States Patent [19]

Stromberg et al.

[11] Patent Number: 6,132,556

[45] **Date of Patent: *Oct. 17, 2000**

[54] METHOD OF CONTROLLING PULP DIGESTER PRESSURE VIA LIQUOR EXTRACTION

[75] Inventors: C. Bertil Stromberg, Glens Falls; J Robert Prough, Queensbury; Bruno S. Marcoccia, S. Glens Falls; Richard O. Laakso, Queensbury; Carl L. Luhrmann, Glens Falls, all of N.Y.

[73] Assignee: Andritz-Ahlstrom Inc., Glens Falls, N.Y.

[ * ] Notice: This patent is subject to a terminal disclaimer.

[21] Appl. No.: 09/192,210

[22] Filed: Sep. 4, 1998

Related U.S. Application Data

[60] Continuation-in-part of application No. 08/712,977, Sep. 12, 1996, Pat. No. 5,824,188, which is a division of application No. 08/291,918, Aug. 18, 1994, Pat. No. 5,575,890, which is a continuation-in-part of application No. 08/148,269, Nov. 8, 1993, Pat. No. 5,536,366, which is a continuation-in-part of application No. 08/127,548, Sep. 28, 1993, Pat. No. 5,547,012, which is a continuation-in-part of application No. 08/056,211, May 4, 1993, Pat. No. 5,489,363.

[51] Int. Cl.[7] ..... D21C 7/14

[52] U.S. Cl. ..... 162/41; 162/43; 162/49; 162/238

[58] Field of Search ..... 162/49, 41, 238, 162/43

[56] References Cited

U.S. PATENT DOCUMENTS

| | | | |
|---|---|---|---|
| 4,670,098 | 6/1987 | Thorsell | 162/29 |
| 5,326,433 | 7/1994 | Ryham et al. | 162/14 |
| 5,489,363 | 2/1996 | Marcoccia et al. | 162/43 |
| 5,575,890 | 11/1996 | Prough et al. | 162/34 |

FOREIGN PATENT DOCUMENTS

| | | |
|---|---|---|
| 0476230 | 3/1992 | European Pat. Off. . |
| 517689 | 5/1992 | European Pat. Off. . |
| WO 94/25668 | 5/1994 | WIPO . |
| WO 96/02698 | 2/1996 | WIPO . |

OTHER PUBLICATIONS

MacDonald. R.G. "The Pulping of Wood", vol. 1, 2nd edition, pp. 471–478, 1969.

Hartler, N., "Extended Delignification . . . A new Concept", Svensk Pappersidning 15:483.

Marcoccia, B.S. "Lo–solids . . . Applications", Memo of Oct. 1995.

Greenw0od, "Continuous Digesters", Kamyr, Inc., Bulletin No. KGD1815–RW491, Apr., 1, 1991.

*Primary Examiner*—Dean T. Nguyen
*Attorney, Agent, or Firm*—Nixon & Vanderhye P.C.

[57] ABSTRACT

A method of controlling the pressure of a vertical continuous comminuted cellulosic fibrous material (wood chip) digester is provided using a pressure-control extraction in a zone relatively insensitive to changes in the flow rate of liquid introduction or removal. The method comprises controlling the pressure in the digester primarily (or substantially exclusively) by varying the flow rate of liquor extracted from the pressure-control extraction to maintain the pressure in the digester at a desired superatmospheric level while avoiding non-uniform, unstable material movement in the counter-current washing zone; and introducing dilution liquid into the digester at the at least one recirculation-dilution loop. The pressure-control extraction is preferably substantially the upper extraction in the digester. Substantially except during excessive over pressure and under pressure conditions the extraction flow from the main extraction is maintained substantially constant. Substantially only during excessive over pressure and under pressure conditions pressure control may also be practiced by controlling the rate of dilution into the at least one recirculation-dilution loop, and the extraction from the main extraction.

20 Claims, 5 Drawing Sheets

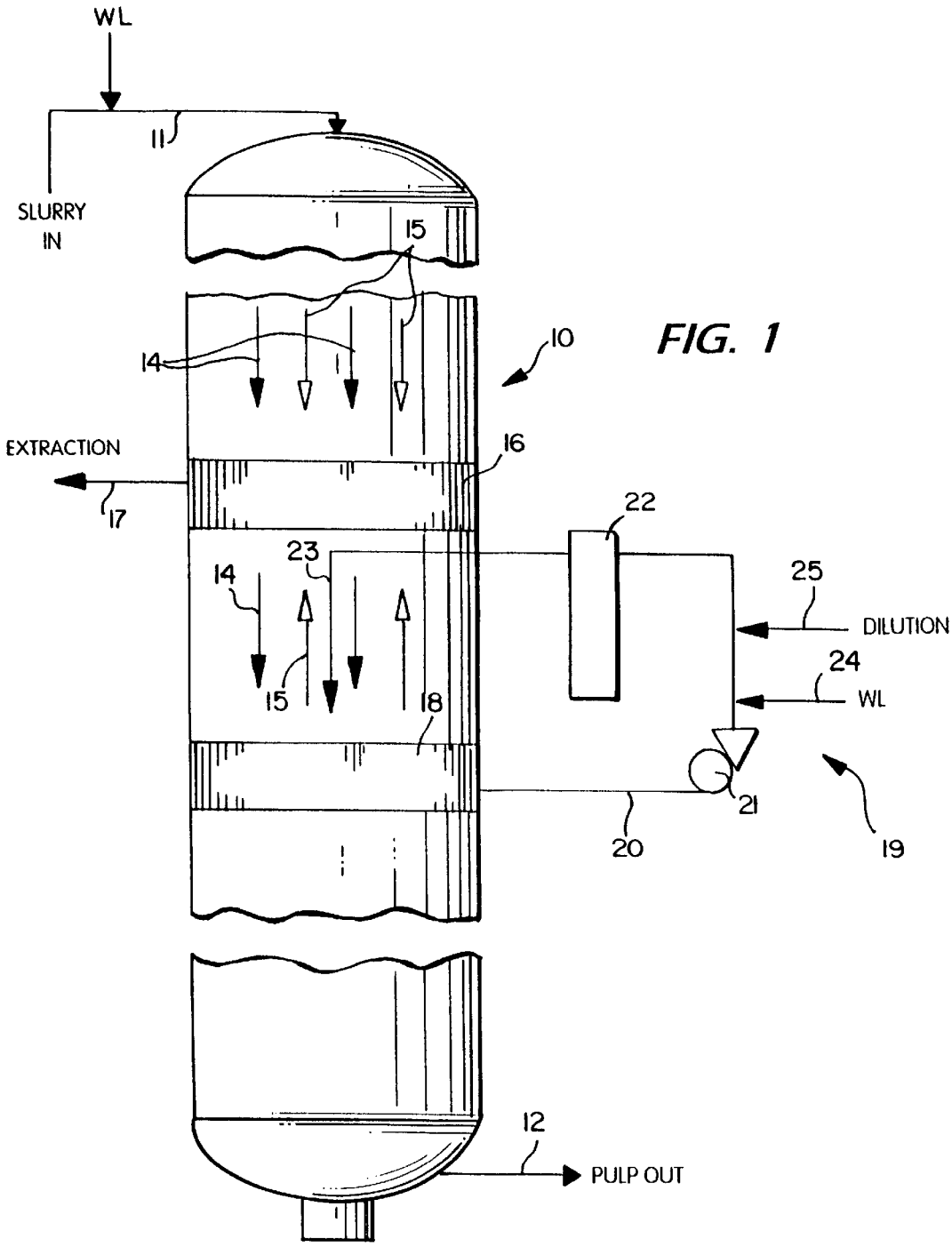
FIG. 1
FIG. 2A
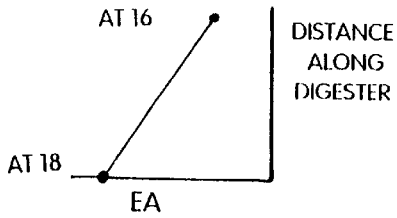
FIG. 2B
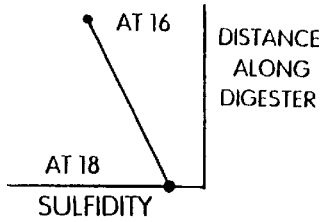

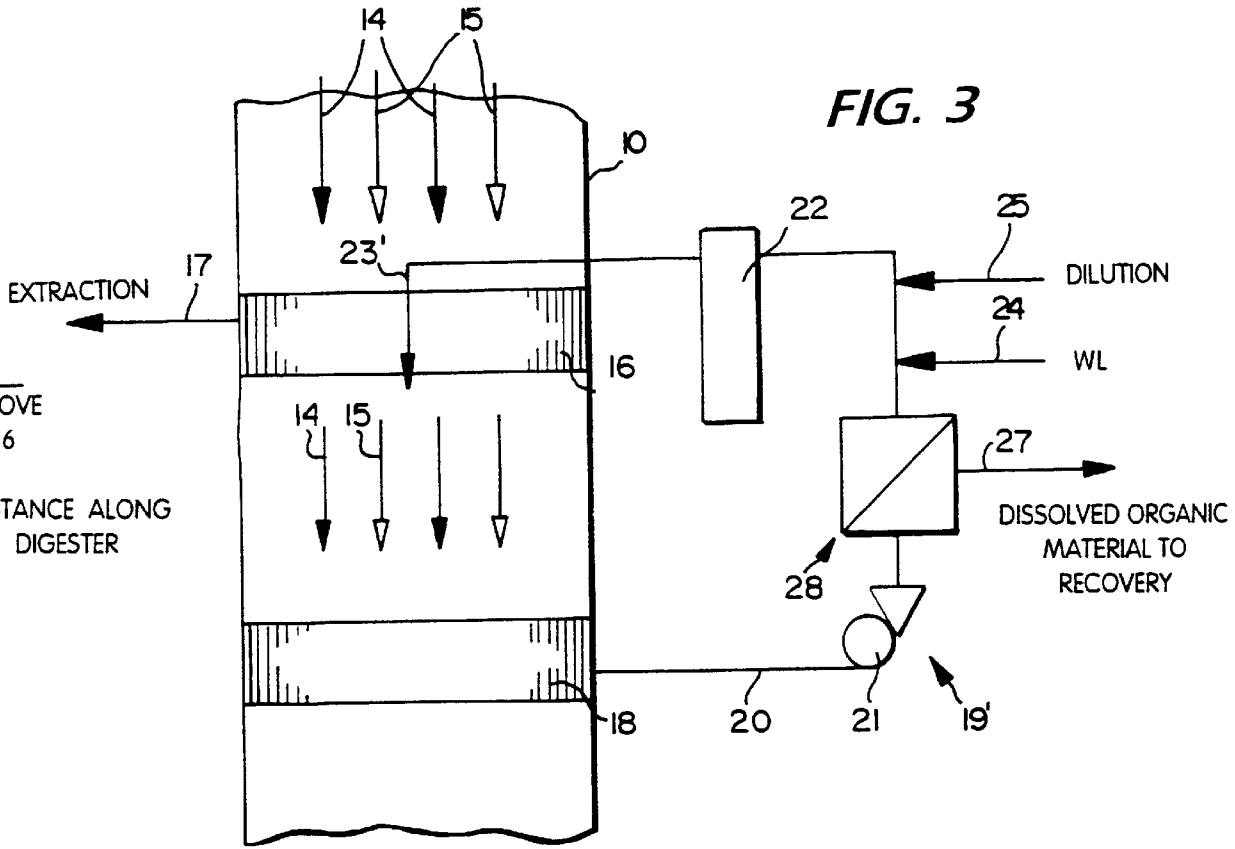
FIG. 3
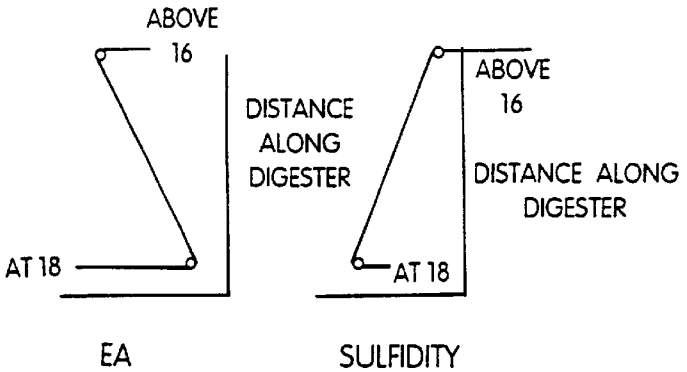
FIG. 4A
FIG. 4B

METHOD OF CONTROLLING PULP DIGESTER PRESSURE VIA LIQUOR EXTRACTION

CROSS REFERENCE TO RELATED APPLICATIONS

This application is a continuation-in-part of application Ser. No. 08/712,977 filed Sep. 12, 1996, now U.S. Pat. No. 5,824,188 which in turn is a divisional of Ser. No. 08/291,918 filed Aug. 18, 1994 now U.S. Pat. No. 5,575,890 which in turn is a continuation-in-part of application Ser. No. 08/148,269 filed Nov. 8, 1993 now U.S. Pat. No. 5,536,366, which in turn is a continuation-in-part of application Ser. No. 08/127,548 filed Sept. 28, 1993 now U.S. Pat. No. 5,547,012, which in turn is a continuation-in-part of application Ser. No. 08/056,211 filed May 4, 1993 now U.S. Pat. No. 5,489,363, the disclosures of these applications being incorporated by reference herein.

BACKGROUND AND SUMMARY OF THE INVENTION

In the parent applications, a unique technique for enhancing kraft cooking is provided utilizing one or more circulation-dilution loops in addition to conventional extraction and dilution mechanisms, and by reintroducing liquor having lower dissolved organics (such as dissolved cellulose, lignin and hemicellulose) than the withdrawn liquor. It has now been found, according to the present invention, that the same basic technique of additional circulation-dilution loops can be utilized to perform other worthwhile functions. In particular, according to the present it has been found that a method—utilizing the additional circulation/dilution loops—for selectively increasing the sulfidity and sulfide ion concentration of the kraft cooking liquor (e.g. white liquor) during kraft cooking of comminuted cellulose fibrous material (wood chips) may be provided, which is especially advantageous at or near the impregnation and/or first cooking zones. It has also been found according to the present invention that such additional circulation-dilution loops can be utilized to maintain the pressure in the digester at a desired superatmospheric level (e.g., the conventional level of about 165 psi) or maintain the liquor level in a manner that avoids non-uniform unstable material movement in the countercurrent washing zone, and—depending upon the particulars of the method—anywhere in the digester.

The active cooking chemicals in kraft cooking liquor, e.g. white liquor, are sodium hydroxide, NaOH, and sodium sulfide, $Na_2S$. In an aqueous medium these chemicals hydrolyze based upon the following reactions $$NaOH+H_2O6Na{+}{+}OH{-}{-}{+}H_2O$$

$$Na_2S+H_2O62Na{+}{+}OH{-}{-}{+}HS{-}{-}$$

The resulting active ions that are significant to kraft cooking are the hydroxyl ions, $OH^-$, and the hydrosulfide ions, $HS^-$. The actual role of these ions are quite different. The hydroxyl ion attacks both the cellulose components of the wood and the lignin. It is believed that the hydrosulfide enhances the hydroxyl ions reaction with the lignin to improve lignin removal, or delignification.

During the cooking process, especially continuous processes, the concentration of hydroxyl ions, or effective alkali (EA), is reduced as the cooking process proceeds. That is, the hydroxyl ions are consumed during the pulping process while the hydrosulfide ion is essentially unaffected.

In the early 1980's, in studies performed at the Swedish Royal Institute of Stockholm (STFI), Sjoblom and others showed that the presence of high concentrations of the hydrosulfide ion in the early stage of kraft cooking improved the resulting yield of the cook. Since that time, efforts have been made to increase the concentration of the hydrosulfide ion, or the sulfidity, of the cooking liquor by chemical addition or manipulation of the recovery process. Examples of such efforts are illustrated in co-pending U.S. application Ser. No. 07/918,855 filed Jul. 27,1992 (Attorney Docket 30-199). The invention takes a much different approach. According to the invention there is provided a new process by which sulfide ion concentration and sulfidity can be enhanced without resorting to chemical addition or manipulation of recovery processes. The invention increases sulfide ion concentration and sulfidity at selected points in a digester by simply manipulating liquor flows.

According to a first aspect of the present invention a method of selectively increasing both the sulfidity and sulfide ion concentration of kraft cooking liquor during kraft cooking of comminuted cellulosic fibrous material is provided. The method comprises the steps of continuously: (a) In a first treatment zone in which impregnation or kraft cooking of comminuted cellulosic fibrous material takes place, causing the material in a slurry of kraft cooking liquor having a first sulfide ion concentration and sulfidity to flow in a first direction through the first zone, from the beginning of the first zone to the end of the first zone. (b) Extracting black liquor from the material at some point after the first treatment zone. (c) Also at some point after the first treatment zone, withdrawing liquid from the material, and adding dilution liquid to the withdrawn liquid, and re-introducing the withdrawn liquid with dilution liquid to the material. And, (d) in a second treatment zone after the first zone subjecting the material to a second kraft cooking liquor having a second sulfide ion concentration and sulfidity greater than the first sulfide ion concentration and sulfidity, including by manipulating and controlling the flow rate of extraction in step (b) and the flow rates of withdrawal of liquid and addition of dilution liquid in step (c).

In the method as described above, steps (b) through (d) are typically practiced so that the second sulfide ion concentration and sulfidity are at least about 20% greater than the first sulfide ion concentration and sulfidity, typically about 20–50% greater, and preferably about 30–40% greater. Also during the practice of step (c) desirably at least half of the dissolved organics are removed from the withdrawn liquor (e.g. by ultra-filtration) prior to re-introduction.

The first zone may be an impregnation zone of a continuous digester or in an impregnation vessel connected to a continuous digester. The first zone may be a vertical co-current cooking or impregnation zone above an extraction screen in a vertical continuous digester. Step (c) may then be practiced so that the reintroduced liquid flows primarily countercurrent to cellulosic material in a second zone in the vertical continuous digester, below the first zone; or step (c) may be practiced to reintroduce the liquid adjacent the beginning of a second co-current zone just below the extraction screen in the vertical continuous digester.

According to another aspect of the present invention a method of increasing the sulfide ion concentration and sulfidity of kraft cooking liquor during kraft cooking of comminuted cellulosic fibrous material comprises the following continuous steps: (a) In a first treatment zone in which impregnation or kraft cooking of comminuted cellulosic fibrous material takes place, causing the material in a slurry of kraft cooking liquor having a first sulfide ion concentration and sulfidity to flow in a first direction through the first zone, from the beginning of the first zone to the end of the first zone. (b) At the end of the first zone removing a substantial amount of the cooking liquor. (c) In a second zone, following the first zone, causing the material to flow counter-currently to the flow of cooking liquor. And, (d) at the beginning of the second zone introducing the material to a second cooking liquor having a higher (e.g. about 20–50%, preferably about 30–40%) sulfide ion concentration and sulfidity than the first liquor.

In a continuous digester the comminuted cellulosic material (chips) flow as a uniform "plug" within the digester. The expression "chip column movement" is often used to describe this flow. This preferred plug flow provides a relatively uniform matrix through which cooking liquor and wash liquor can pass. Although not common, operating conditions which deviate from the design conditions for a digester can cause non-uniformities or discontinuities in this chip matrix which may create areas in which liquor flow may not be uniform. Dislocations or breaks in the chip matrix may create areas in which liquor flow may not be uniform. Dislocations or breaks in the chip column may provide areas where liquor is not distributed uniformly and may result in liquor "channeling". Chips may also channel. Unstable chip columns may have areas where chip movement is not uniform. Chips may move faster in one region than in another.

When chip or liquor movement deviates from the ideal flow, non-uniformities in the cooking process and in the washing process may occur. White liquor which channels can preferentially cook chips adjacent to the channel while other chips are left partially cooked or undercooked. Wash liquor that channels decreases the washing efficiency and results in increased carry-over of dissolved solids and cooking chemicals to the downstream process.

Another aspect of the chip column that affects the uniformity of the cooking and washing process is the chip column "compaction". The weight of the chips and liquor above a section of chips ideally, uniformly compresses the chips so that uniform resistance to liquor flow occurs. If the chip column is not uniform, for example, if the chips are restrained by liquor flow out an extraction screen, i.e., "the hung digester", the chip compaction beneath the screen may be less than that further away from the screen. These areas of reduced compaction may provide regions of reduced resistance to liquor flow and promote liquor channeling.

The introduction of cooking or wash liquor at various locations in the digester may affect the desired uniformity of the chip column. In some situations, fluctuations in this introduction of liquor may further exacerbate the impact this liquor can have on the chip column uniformity and movement.

One liquor source to the digester is the wash filtrate introduction which is also used for pressure control (i.e., "PV-11" in conventional continuous hydraulic digesters, including MCC® and EMCC® digesters available from Kamyr, Inc.). The pressure within the digester is controlled by a closed-loop control to a specified value, typically 130–170 psi (e.g. about 165 psi). The pressure within the digester varies due to the amount of chips and liquor fed to the top of the digester, the amount of pulp blown from the digester, the amount of extraction flow removed, the amount of wash filtrate flow added, and other variables. The conventional preferred method of controlling the pressure is to increase or decrease the flow of liquor through valve PV-11. PV-11 is typically located below the wash screens in a Kamyre® digester and supplies pressurized wash liquor (i.e., "cold blow" liquor) from the downstream brownstock washers.

In some digesters, the vessel pressure is controlled by varying the extraction flow out of the vessel, but this is not a preferred method. Conventionally, the "extraction flow" out of a continuous digester is removed by a screen assembly located in the cooking zone or shortly thereafter. However, since the cellulose material has received some form of heating and/or cooking at this point in the process, the cellulose, for example, softwood chips, are "softer" or more pliable at this point in the treatment. Varying the liquor flow to this region having softer chips to effect pressure control in the vessel can cause undesirable variations in the uniformity of the chip and liquor flow, that is channeling, or screen plugging. Channeling and screen pluggage can lead to non-uniform treatment of the cellulose. The present invention avoids these problems by limiting the variation of liquor removal to areas in the digester where the chips are not as soft and not as sensitive to variations in liquor removal.

As noted previously, the fluctuation in PV-11 flow increases the potential to produce non-uniform, unstable chip movement and liquor flow. In particular, these non-uniformities are promoted in an area that is critical to the efficiency of the counter-current washing/cooking zone directly above. Fluctuations in PV-11 flow increase the potential to produce liquor channeling, non-uniform chip column movement and non-uniform compaction of the chip column.

Another prior art method of controlling the pressure in a continuous digester is the intermittent release of liquor from a cooking circulation to the flash tanks when excessive pressure occurs in the vessel. Typically, a valve, identified in the art as the "PV-10" valve, is located in a cooking circulation of a Kamyr® continuous digester. See, for example, FIGS. 9–36 of *The Pulping of Wood*, edited by MacDonald, et al. (1969). When excess pressure develops in the vessel, that is, beyond the control of the pressure controlling PV-11 valve, for example, the PV-10 valve is opened, typically automatically, to direct liquor from the cooking circulation to the flash tanks to relieve the pressure in the vessel. This release of pressure by the PV-10 avoids the activation of electronic interlocks which shut down the digester, typically by shutting down the high-pressure pumps which feed liquor to the digester. This release of pressure by the PV-10 or similar valves is clearly an intermittent recourse to address high pressures in the digester; it is by no means a method of controlling the pressure in the digester on a continuous basis during normal operation.

According to a second aspect of the present invention, the pressure within a digester is controlled in a simple manner which avoids the problems of the control techniques described above, and in fact results in no disruptions of the column of pulp continuously moving downwardly in the digester anywhere within the digester. According to this aspect of the invention, a method of controlling the pressure of a vertical continuous comminuted cellulosic fibrous material digester, a main extraction, and at least one additional extraction-dilution loop distinct from the main extraction is provided, comprising the step of: (a) Withdrawing liquor from, and introducing liquor into, the digester at the at least one additional extraction-dilution loop to maintain the pressure in the digester at a desired superatmospheric level while avoiding non-uniform, unstable material movement in the countercurrent washing zone. Step (a) is typically practiced to maintain the pressure in the digester at about 130–170 psi (e.g. about 165 psi).

The digester also typically comprises a wash dilution liquid introduction mechanism below the wash screens. In this case there is preferably also the further step (b) of controlling the pressure in the vessel by also, in addition to step (a), controlling the amount of wash dilution liquid introduced into the digester by the wash dilution liquid introduction mechanism (e.g. PV-11). There may also be the further step (c), in addition to step (a), or in addition to steps (a) and (b), of controlling the pressure in the vessel by also varying the extraction flow out of the digester through the main extraction. Alternatively, the control of pressure in the digester, by manipulating liquid extractions and introductions, may consist of (that is be provided only by) the practice of step (a), although still there will be other variables which can control the pressure including the amount of chips and liquor fed to the top of the digester, etc., as described above.

At least two additional extraction-dilution loops may be provided, in which case step (a) may be practiced by varying the liquid flow into and out of the digester using at least two different extraction-dilution loops. The volume and location for introduction of pressure controlling liquid can be controlled to least-affect the column movement in the digester. The optimum volume and location will vary from digester to digester, depending upon which area in the digester has the most stable column movement. However in all cases the significant potential source of non-uniform liquor distribution and non-uniform column movement in the critical counter-current washing/cooking zone is minimized or eliminated.

According to another aspect of the present invention, a method of controlling the pressure of a vertical continuous digester is provided comprising the steps of: (a) withdrawing liquor from, and introducing liquor into, the digester at the at least one additional extraction-dilution loop to maintain the pressure in the digester at a desired superatmospheric level; and (b) controlling the pressure in the vessel by also, in addition to step (a), controlling the amount of wash dilution liquid introduced into the digester by the wash dilution liquid introduction mechanism; or (c) controlling the pressure in the vessel by also, in addition to step (a), varying the extraction flow out of the digester; step (a), and at least one of steps (b) and (c), being practiced to avoid disruptions of a column of pulp continuously moving downwardly in the digester anywhere in the digester.

Of course the selective sulfide ion concentration and sulfidity increasing aspect of the invention may be combined with the continuous digester pressure control aspect of the invention, so that the advantages of both are obtained in a continuous digester, and they both can be obtained at the same time utilizing the same circulation/extraction-dilution loop or loops.

According to the preferred aspect of the present invention, a method of controlling the pressure of a vertical continuous comminuted cellulosic fibrous material digester is provided that is advantageous because it varies the liquor flow to the digester at a point where the effect upon column movement and treatment is minimized. Specifically, this point in the cooking process occurs before the chips are exposed to cooking temperature and become "softer", that is, more pliable and prone to compaction. This softer, more pliable chip mass is more sensitive to variations in liquor movement that can result in stagnation or channeling of chips and liquor or both. These softer, more pliable chip masses typically occur in the latter stages of cooking, toward the bottom of the digester. Also, since changes to the flow patterns in the bottom of the digester can affect the flow patterns throughout the height of the digester, it is preferred to avoid any variations in liquor flows to the lower part of the digester. This lower part of the digester may be a counter-current or a co-current zone, it may be a cooking or a washing zone. The digester includes a main extraction, a treatment zone, a pressure-control extraction (e.g. in a zone—at an upper part of the digester—relatively insensitive to changes in the flow rate of liquid introduction or removal), and optionally at least one recirculation-dilution loop distinct from the main extraction and the pressure-control extraction. The method comprises: (a) Controlling the pressure in the digester primarily by varying the flow rate of liquor extracted from the pressure-control extraction to maintain the pressure in the digester at a desired superatmospheric level while avoiding non-uniform, unstable material and liquid movement in the treatment zone. There may also be (b) introducing dilution liquor into the digester at the at least one recirculation-dilution loop.

According to the present invention a liquor is extracted to control pressure early in the treatment having an effective alkali (EA) which is lower than the EA of the liquor removed later in the treatment. Typically, prior art systems for controlling pressure in a digester, such as the system shown by MacDonald, extract liquor during the cooking stage or after the cooking stage having an EA greater than 15 grams per liter (g/l) as NaOH. According to the present invention, the EA of the liquor removed is typically less than 15 g/l, preferably less than 10 g/l. Among other things, the removal of liquor having a lower EA compared to one having a higher EA does not waste cooking chemical.

Also, according to the present invention, liquor is preferably removed from the chips at a location prior to the cellulose material being heated, for example, to cooking temperature. That is, according to the present invention, pressure is controlled in the vessel by removing liquor prior to cellulose material and liquor being heated to a temperature of 150° C., typically 140° C., and preferably before it is heated to 130° C. Controlling the pressure by removing the liquor prior to heating has the advantages of removing wood moisture prior to heating to avoid wasting energy heating the wood moisture and also avoiding the thermal inefficiency of removing liquor after the liquor has been heated.

Furthermore, the control of pressure within a digester by extraction in the upper part of the vessel is not limited to digesters having a dilution-extraction stage. The broadest embodiment includes a digester having a first extraction stage below or during the cooking process and a second pressure-controlling extraction above or before the cooking process. The lower extraction is preferably held relatively constant, the upper extraction is varied based upon vessel pressure.

In the method (a) may be practiced by substantially exclusively (that is except for during excessive over pressure or under pressure conditions) by varying the flow rate of liquor extracted from the pressure-control extraction. Usually (a) is practiced by controlling the amount of flow through a flow control valve, such as by automatically controlling the flow control valve in response to pressure sensed by at least one pressure sensor. The practice of (a) is typically effected to control the pressure in the digester to be at a predetermined level within the range of 130–170 psi gage. Substantially only during excessive over pressure and under pressure conditions, (a) is also practiced by controlling the rate of extraction or dilution from or to at least one of the at least one recirculation-dilution loop and the main extraction. That is substantially except during excessive over pressure and under pressure conditions the extraction flow from and dilution flow into the at least one recirculation-dilution loop and the main extraction are maintained substantially constant. It is understood that the flow of dilution and extraction liquor will vary with the rate of production. That is, the nominal flow of dilution and extraction, including the main extraction, may vary with changes in the production rate.

Cold blow filtrate and washer filtrate are preferred as the dilution liquors in practicing (b), although other dilution liquors may be used. Also preferably the pressure-control extraction is substantially the first extraction of the digester, and (a) is practiced above or before the main extraction and above or before the at least one recirculation-dilution loop, preferably where a co-current zone is provided thereabove.

It is the primary object of the present invention to increase the effectiveness and practicality of kraft cooking of comminuted cellulosic fibrous material in the production of cellulosic (paper) pulp. This and other objects of the invention will become clear from an inspection of the detailed description of the invention and from the appended claims.

BRIEF DESCRIPTION OF THE DRAWINGS

FIG. 1 is a schematic side view of an exemplary continuous digester utilizing the method of selectively increasing the sulfidity and sulfide ion concentration of kraft cooking liquor during kraft cooking, according to the present invention;

FIGS. 2A and 2B are schematic representations of the effective alkali (EA) and sulfidity of the liquor as it moves downwardly between the two screens in the digester of FIG. 1;

FIG. 3 is a view like that of FIG. 1 only for different types of digester flow;

FIGS. 4A and 4B are schematic representations of the effective alkali (EA) and sulfidity of the liquor as it moves downwardly between the two screens in the digester of FIG. 3;

DETAILED DESCRIPTION OF THE DRAWINGS

Figure 5:
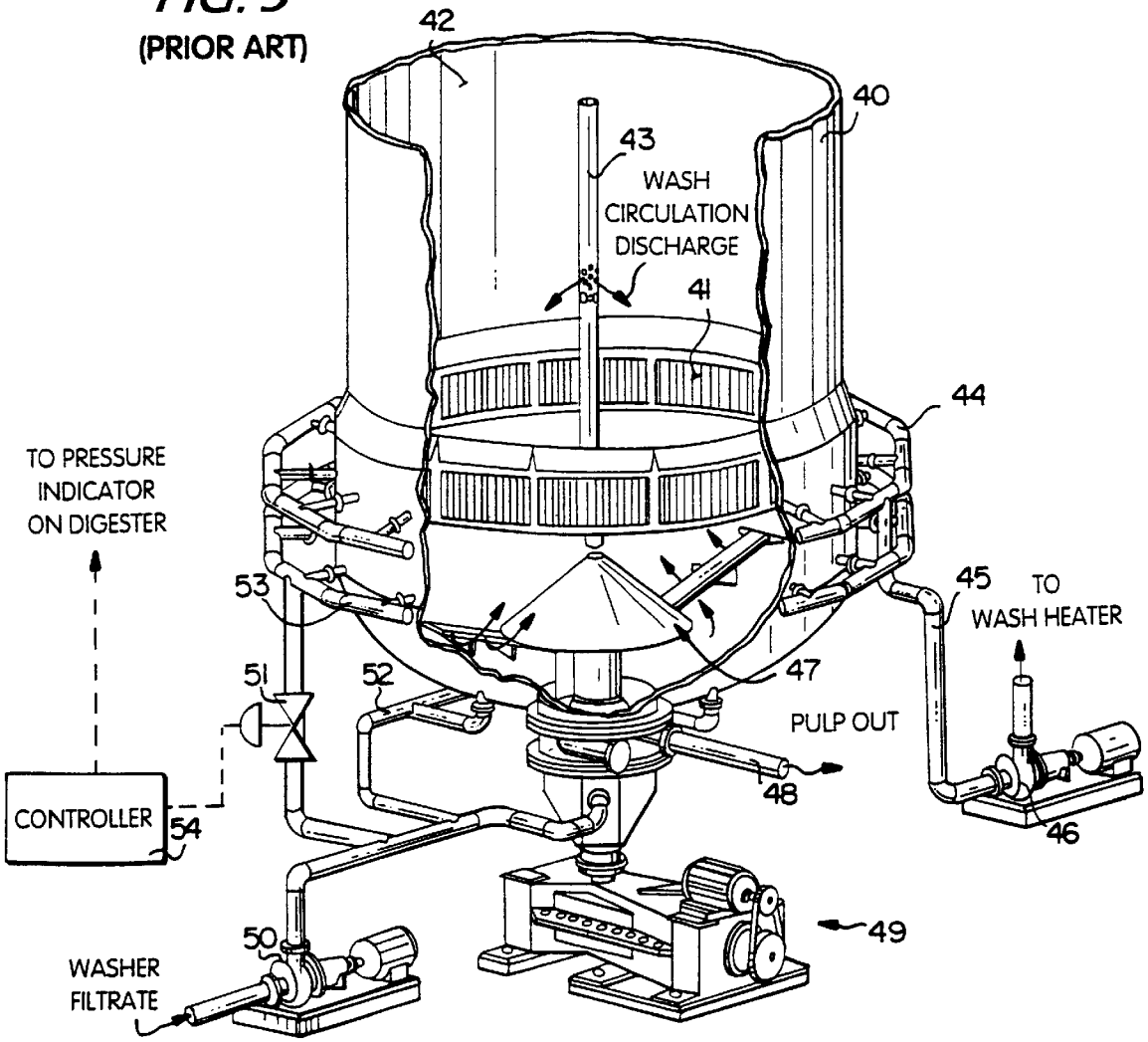
FIG. 5 (PRIOR ART)
FIG. 5 is a bottom detail perspective view, with portions of the digester shell cut away for clarity of illustration, of the most common pressure control mechanism in conventional Kamyr, Inc. continuous digesters.

FIGS. 1 through 4 schematically illustrate a method of selectively increasing the sulfidity and sulfide ion concentration of white liquor, or other kraft cooking liquor, during kraft cooking according to the present invention, as practiced in a continuous digester 10 (or continuous impregnation vessel). In the particular embodiment illustrated in FIG. 1 a counter-current cooking zone is provided. In the digester 10 (such as one available from Kamyr, Inc. of Glens Falls, N.Y.) a slurry of comminuted cellulosic fibrous material in white or black liquor (kraft cooking liquor), typically wood chips in white liquor, is introduced at the top as indicated by 11, while digested pulp is removed from the bottom as indicated by line 12. At upper stages of the vessel 10 the chips flow is indicated by solid head arrows 14 while free or unbound liquor flows as indicated by the blank arrow heads 15, that is, co-currently. A conventional extraction screen 16 is provided from which black liquor is extracted in line 17 at a controlled rate (e.g. by controlling pumps, valves, or other flow control devices as known per se). Above screen 16 is a first co-current impregnation or cooking zone.

A circulation/dilution loop screen 18 according to the present invention is provided below the extraction screen 16 in the FIG. 1 embodiment, and in the second zone between the screens 16, 18, counter-current cooking is provided, as indicated by the differently directed arrows 14, 15 therein. The entire loop 19 may be as described in the parent applications, any particular items of apparatus therein being utilizable in the loop 19. In the embodiment actually illustrated in FIG. 1 the loop 19 includes a withdrawal line 20 connected to the screen 18, a pump 21, a heater 22, and a reintroduction conduit 23 for reintroducing the withdrawn and heated liquor above the screen 18 (near the bottom of the second zone) to flow counter-currently—as indicated by arrows 15—to the extraction screen 16.

In the system of FIG. 1, the sulfide ion concentration in the black liquor is increased by first removing diluted weak black liquor through screen 16 by conduit 17. The liquor above screen 16 in the co-current impregnation/cooking (first) zone has been diluted by, among other things, the condensate introduced during chip steaming and by the moisture present in the original chips. The weak liquor is replaced by the relatively stronger liquor which passes counter-currently upward below screen 16 from the second zone. The amount of weak liquor displaced by the stronger liquor depends upon the extraction flow in line 17. The extraction in line 17 must exceed the flow of free liquor flowing co-currently above the screen 16 to ensure displacement of weak liquor by the stronger liquor.

At the same time, as the liquor below screen 16 flows counter-currently, the sodium hydroxide (alkali) in this liquor is consumed and the hydrogen sulfide is essentially unchanged. This consumption of alkali produces a liquor with low alkalinity yet still containing a sulfide content greater than the liquor above screen 16. As a result, the relative sulfide ion concentration of the liquor below screen 16 is essentially the same as the liquor introduced by conduit 23 but, more importantly, its alkalinity is lower than the liquor introduced by conduit 23. Thus, below screen 16 the chips are introduced to liquor having a high sulfide ion concentration but a low alkalinity. Liquor having the same sulfide ion concentration but a lower alkalinity (i.e., less OH—) is, by definition, higher in "sulfidity". Thus, the desired cooking liquor in the second zone can be characterized as having a relatively high sulfide ion concentration and a high sulfidity, both at least about 20% higher (typically about 20–50%, and preferably about 30–40% higher) than in the first zone (above screen 16).

Though what has been described above is essentially MCC7 cooking, the versatility of this method is enhanced by combining its effects with those obtained according to the parent applications. The presence of the low DOM dilution, from line 25, permits the further manipulation of not only sulfide ion concentration and sulfidity but also of dissolved organic material (DOM) concentration. By increasing the volume of dilution flow (from line 25) the sulfide ion concentration can be decreased. By increasing extraction flow (in line 17) the sulfide ion concentration can be increased, for a given dilution flow.

FIG. 2A schematically illustrates the decrease in effective alkali that occurs in the vessel 10 as the cooking process proceeds, the hydroxyl ion being consumed. FIG. 2B illustrates schematically the commensurate increase in sulfidity that occurs, which is a result of the consumption of the hydroxyl ion while the hydrosulfide ion is essentially unaffected.

FIG. 3 illustrates essentially the same digester 10 as in FIG. 1 only in this case the dilution-circulation/extraction loop 19' is operated so that the second zone, between the extraction screen 16 and the circulation/extraction screen 18, is a co-current cooking zone, as indicated by the unidirectional arrows 14, 15. In the FIG. 3 embodiment, the components of the loop 19' may be the same as for the loop 19 except that the re-introduction conduit 23' will re-introduce the withdrawn liquor having greater sulfidity and sulfide ion concentration than the liquor above the screen 16, immediately below the extraction screen 16, that is, adjacent the start of the co-current cooking zone. Also, in this embodiment, a dissolved organics removal mechanism 28 is illustrated in the extraction loop 19'. The mechanism 28 may be any of the mechanisms discussed in the parent applications, such as a filtration apparatus, e.g. ultrafiltration, with the discharged dissolved organics therefrom (such as hemicellulose and liginin) passing to recovery in line 27. Preferably, the apparatus 28 removes at least about half of the dissolved organics from the withdrawn liquor.

In the FIG. 3 embodiment, weak black liquor is also removed by extraction in line 17, but in this case it is replaced by stronger liquor introduced via line 23' near the top of the second zone (between screens 16, 18), and just below the screen 16. The liquor introduced at 23' was extracted at screen 18 after having its sodium hydroxide consumed during the co-current cook between screens 16, 18 in the second zone. The sulfide ion concentration can be manipulated by changing the dilution addition in line 25, the extraction in line 17, and the like.

In both the FIGS. 1 and 3 embodiments, the white liquor introduced in line 24, if provided, may have a sulfidity and a sulfide ion concentration more than 20% (e.g. more than 50%) greater than the sulfidity and of the cooking liquor above the screen 16, for example the white liquor at 24 being produced utilizing the recovery techniques as described in co-pending application Ser. No. 07/918,855 (atty. dkt. 30-199).

FIGS. 4A schematically illustrates the decrease in effective alkali that occurs in the vessel 10 of FIG. 3 as the cooking process proceeds, the hydroxyl ion being consumed. FIG. 4B illustrates schematically the commensurate increase in sulfidity that occurs, which is a result of the consumption of the hydroxyl ion while the hydrosulfide ion is essentially unaffected.

While FIGS. 1 and 3 show practice of this aspect of the invention in a continuous digester at an initial cooking zone, it is to be understood that an invention—including utilizing loops 19,19' of FIGS. 1 and 3—is applicable to an impregnation zone in the continuous digester, a separate impregnation vessel, or indeed anywhere within the continuous digester where increased sulfidity and sulfide ion concentration compared to the prior art would be a benefit. Also conventional split-sulfidity techniques may also be employed, where a wide variety of different sulfidity cooking liquors are introduced at different points.

Figure 6:
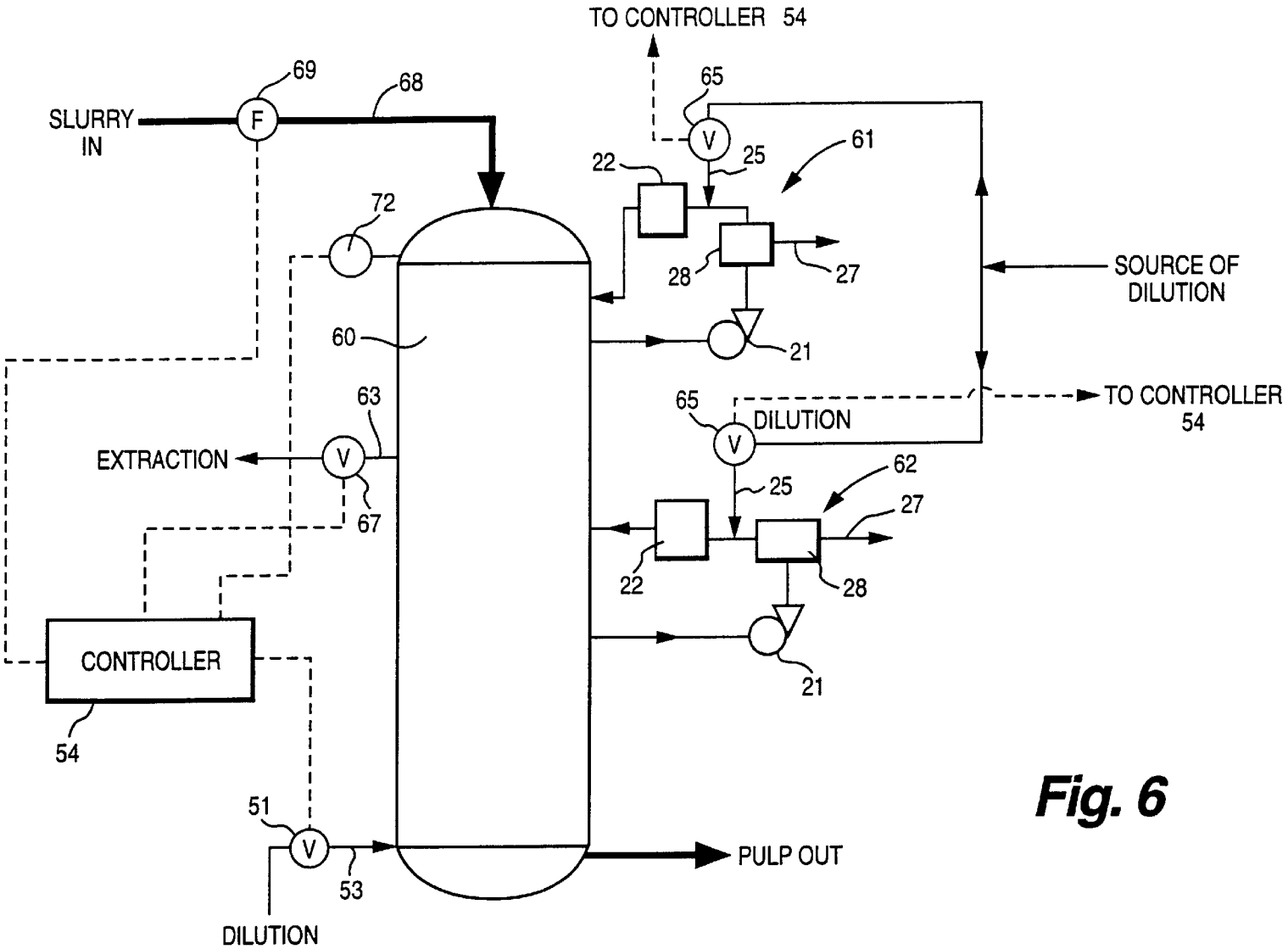
FIG. 6 is a side schematic view of an exemplary vertical continuous digester utilizing the method according to the present invention of controlling the pressure therein.

FIGS. 5 and 6 illustrate the pressure control aspect of the present invention. FIG. 5 schematically illustrates the bottom portion of a Kamyr® continuous digester 40 having wash screens 41, a central distribution chamber 42 with liquid discharge pipe 43, wash circulation header 44 which receives wash liquor from the screens 41 and recirculates it via conduit 45 and wash circulation pump 46 to a conventional wash heater, and then to the pipe 43. An outlet device 47 is also typically provided to facilitate movement of the digested pulp out of the digester 40 through the pulp outlet 48, the device 47 typically being driven by a direct drive 49.

For primary pressure control within the digester 40 the cold blow pump 50, and pressure control valve 51—known as "PV-11" in Kamyr® continuous digesters—are provided. Counter wash liquor is introduced into the bottom of the digester 40 via line 52 utilizing pump 50, while the majority of the washer filtrate pumped by the pump 50 flows through valve 51 to the digester dilution header 53. While the pressure can properly be controlled within the digester 40 by controlling the valve 51, as with a conventional controller 54 which receives pressure information from within the vessel 40, there is a drawback to this technique. This technique may result in fluctuations in liquor flow to the bottom of the counter-current cooking/washing zone in chamber 42. This may result in non-uniform liquor distribution and non-uniform column movement in a critical area, and may adversely affect the digester operation and the efficiency of treatment.

According to the present invention the problem described above is essentially eliminated, or at least greatly minimized. FIG. 6 schematically illustrates the invention in which the pressure within the continuous digester 60 is controlled. The pressure is primarily controlled in the digester 60 by controlling the amount of liquor withdrawn and introduced in the extraction/dilution loop 61, 62, which are distinct from the main extraction 63 (corresponding to the screen 16 and line 17 in FIG. 1). Each of the loops 61, 62 may be like the loop 19' illustrated in FIG. 2, including having a heater 22, pump 21, dissolved organics removal device 28, etc. By varying the amount of dilution liquor provided in the loops 61, 62 via the lines 25 (as by controlling the valves 65 utilizing the controller 54, or other components), and by controlling the amount of extraction removed via lines 27, the pressure in digester 60 is controlled.

While FIG. 6 illustrates two additional circulation/extraction-dilution loops 61, 62 (in addition to the main extraction 63 and the dilution header 53 associated with the valve 51), only one loop 61, 62 can be provided under some circumstances, or more than two loops under other circumstances. In any event, pressure control utilizing the loop or loops 61, 62 avoids non-uniform unstable material movement in the countercurrent washing zone 42 of FIG. 5, and the loops 61, 62 can be provided wherever desired within the digester 60 to ensure proper column movement given the particulars of that digester.

While pressure control utilizing essentially only the loop or loops 61, 62 may be provided according to the present invention, again depending upon the particular digester 60, conventional pressure control techniques can additionally be utilized. For example, the valve 51 may still be controlled by the controller 54 to introduce digester dilution liquor below the wash screens (41 in FIG. 5), only because the volume of added liquor will be less than in the conventional digester, control will be better and there will be less disruptions to the chip column at the critical counter-current washing zone. Also, the controller 54 may control a valve 67 in the main extraction 63 to also control the pressure of the digester 60 that way. Also since the pressure in the vessel 60 is in some way dependent upon the amount of chips and liquor fed to the top of the digester in line 68, the controller 54 may also control a flow controlled mechanism 69 in the line 68, only this would be used in only special circumstances.

The pressure in digester 60 is typically controlled so that it is about 130–170 psi (e.g. about 165 psi), which pressure is sensed by pressure indicator 22, which provides an input to the controller 54.

While illustrated primarily with respect to hydraulic digesters, the invention is also applicable to other types (e.g. steam phase) of conventional continuous digesters.

Figure 7:
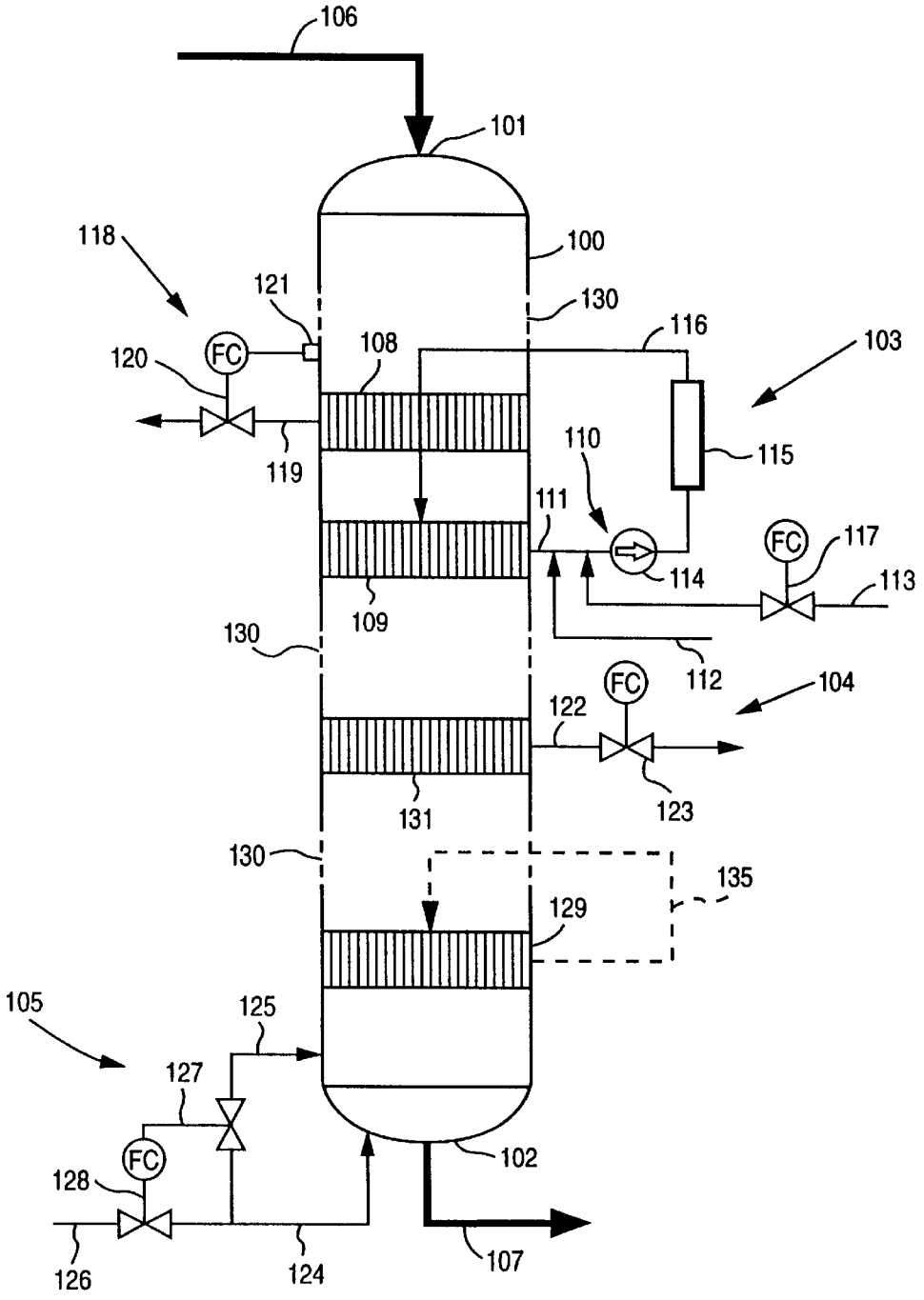
FIG. 7 is a schematic representation of a digester system for practicing a preferred method of controlling the pressure of the digester according to the present invention.

FIG. 7 illustrates another preferred embodiment of the present invention. The vertical, cylindrical digester vessel 100 has an inlet 101 for liquid slurry comminuted cellulosic fibrous material 106 and an outlet 102 for essentially fully-cooked cellulose pulp 107. Digester 100 may be part of single-vessel or multiple-vessel digester system, for example, it may be fed directly by a conventional high pressure feeder, or by an impregnation vessel or other treatment vessel. Digester 100 may be a hydraulic digester or a dual-phase, vapor-liquor digester. The vessel 100 is typically operated at a pressure of between 100–170 psi gage. Vessel 100 also includes structure 103 which extracts liquor having a higher level of dissolved organic material and replaces it with liquid having a lower concentration of dissolved organic material, and a structure 104 which removes spent cooking chemical from the vessel. Vessel 100 may also include a structure 105 which introduces cooler dilution liquor to the pulp prior to discharging the pulp 107 from the vessel.

The structure 103 preferably comprises or consists of a first annular screen assembly 108 and a second annular screen assembly 109 spaced from screen assembly 108 and a device 110 for circulating liquor. Device 110 removes liquor from the vessel 108, augments the liquor by introducing cooking liquor and dilution liquor to the removed liquor, and recirculates the augmented liquor back into the vessel 100 in the vicinity of screen 108. The circulation device 110 preferably includes a conduit 111 for removing liquor from screen assembly 108, a conduit 112 for introducing cooking liquor, and a conduit 113 for introducing liquor having a lower concentration of dissolved organic material, also known as diluent, to the liquor removed by conduit 111. Diluent may comprise or consist of washer filtrate, cold blow filtrate, steam condensate, fresh water, or any other form of low-dissolved-solids- containing liquid. Device 110 also includes a conventional pump 114 for pressurizing the circulation and may include a heat exchanger 115 for heating the liquid prior to returning it to the vessel via conduit 116. In a preferred embodiment, the flow of diluent in conduit 113 is controlled by a flow control (FC) valve 117.

Device 103 also preferably includes a device 118 for removing liquor from screen 108. Device 118 preferably comprises or consists of a conduit 119 for removing liquor from screen assembly 108. In a preferred embodiment, the flow of liquor out of conduit 119 is controlled by pressure control (PC) valve 120. Typically, valve 120 communicates with at least one pressure sensing device 121 located somewhere on the vessel 100. Though the pressure sensing device, or pressure indicator, 121 is shown located adjacent to screen assembly 108, it is to be understood that this device 121 (or multiple devices 121) may be located anywhere in, on, or around the vessel 100 where the pressure in the vessel 100 can be detected. The liquor removed via conduit 119 may be forwarded to the chemical recovery system or may be used as needed in and around the digester 100 system. For example, it may be used for pretreatment of the comminuted cellulosic fibrous material prior to its being introduced to the digester 100 or it can be used as a source of heat to heat cooler liquors.

The device 104 for removing spent cooking liquor from the vessel 100 typically comprises or consists of a screen assembly 131 for removing liquor from the vessel 100 and a conduit 122 for removing liquor from the screen assembly 131. The flow of liquor through conduit 122 is preferably controlled by flow control valve 123. The device 104 is typically referred to as the "main extraction" of the digester 100, but the amount of liquor removed through conduit 122 may be less than, equal to, or greater than the amount of liquid removed through conduit 119.

The device 105 for introducing dilution liquor to the bottom of vessel 100 typically comprises or consists of one or more conduits 124 and 125 for introducing cooler, cleaner liquid 126 to the pulp prior to discharging the pulp 107 from the vessel 100. Though shown as single conduits, the flow in conduits 124 and 125 typically is distributed by a series of conduits, or a distribution header and a series of conduits or nozzles, attached to the vessel 100. Liquor 126 is typically referred to as "cold blow filtrate" and typically comprises or consists of cooler washer filtrate taken from a downstream washer, though other sources of filtrate may be used. As is typical, and in a preferred embodiment of this invention, the flow in conduits 124 and 125 is regulated by flow control valves 127 and 128.

The vessel 100 may also include additional screen assemblies in addition to those shown, such as screen assembly 129. Screen assembly 129 may include a circulation similar to circulation 110 in which cooking liquor and/or diluent may or may not be added. For example, screen 129 may include a circulation similar to circulation 110, but in which only cooking liquor is added. Screen assembly 129 may include a device 104 or second screen assembly with a device 118 for removing liquor from the vessel.

Though the digester 100 is shown having a device 103 positioned as the upper-most screen assembly in the vessel and followed by device 104, it is to be understood that these devices may be located anywhere in the vessel 100 and may include intervening screen assemblies or more than one devices 103, 104, or 118. As indicated by the dashed lines 130, assorted other treatments and screen assemblies may be located between, before, or after devices 103 and 104. In one preferred arrangement, the extraction-dilution device 103 is located in the upper part of the vessel, and it is followed successively by extraction device 104 and dilution device 105, the main extraction at 131, and the treatment zone adjacent 129.

In a preferred method of operation, a slurry of comminuted cellulosic fibrous material 106, for example, softwood chips, and cooking liquor, at a temperature of 80–140° C., preferably 90–120° C., is introduced to the inlet 101 and passes downward in the vessel. Cooking liquor may comprise or consist of kraft white, green or black liquor, or sulfite liquor, and may contain strength or yield-enhancing additives such as anthraquinone or polysulfide or their equivalents or derivatives. The slurry flows downward in the vessel 100 to the screen 108 where liquor is removed from the slurry by way of the liquor removal device 118. The liquor removed from the vessel by device 118 typically contains wood moisture and is relatively high in dissolved organic material concentration. The flow of liquor above screen 108 may be co-current or counter-current to the flow of cellulose material. The cellulose material passes downward past screen 108 where it encounters heated, cooking-chemical-laden, lower-dissolved-organic-material-containing, upflowing liquor introduced by conduit 116 and drawn upward by the liquor removal of screen 108. This heated counter-current flow of liquid effectively substantially uniformly heats the down-flowing cellulose to a temperature of between 140–180° C., preferably 150–170° C. Liquor is then removed from the slurry by way of the screen assembly 109, augmented with cooking chemical 112 and diluent 113, preferably heated by heater 115, and re-introduced via conduit 116.

The flow of liquor between screens 108 and 109 may also be co-current. For example, a co-current flow of liquor will occur when the liquor flow removed by screen 108 is insufficient to produce a counter-current flow.

The fully-heated and impregnated cellulose passes screen 109 and the cooking process progresses until the slurry encounters screen 131. Though not shown, other treatments, screen assemblies, and associated circulations may be encountered or utilized between screens 109 and 131. The spent cooking liquor containing residual cooking chemical and dissolved products of the cooking reaction is removed by screen 131 and conduit 122. As the slurry passes screen assembly 131 it is exposed to a counter-current flow of cleaner liquor, with or without dilution and/or cooking chemical, which is drawn upward by the liquor removal from screen 131. This cleaner liquor may be introduced in a circulation associated with screen 129 or the cleaner liquor may originate from the liquor introduced via conduits 124 and 125. The slurry then passes screen 129 where further heating may occur via a conventional circulation shown only schematically at 135. Additional cooking liquor and dilution may be introduced in the circulation 135 associated with screen 129.

After passing screen 129 the essentially fully-cooked pulp is cooled and diluted by liquor introduced via conduits 124 and 125. The cooled pulp 107 is then discharged via the outlet 102 and forwarded to further treatment, typically washing and/or bleaching.

In the preferred method of the invention, the pressure within the vessel 100 is primarily or substantially exclusively (i.e except for excessive over or under pressure conditions) controlled by using the pressure control valve 120. The pressure is typically controlled to a predetermined level within the range of between about 130–170 psi gage. Typically, the flows of diluent 113, extraction 122, and cold blow 124, 125 are maintained relatively constant by flow control valves 117, 123, 128 and 127, respectively. The pressure within the vessel 100 is then regulated using the pressure indicator 121 and the flow control valve 120 in the upper (not counting recirculation to the high pressure feeder or impregnation vessel) extraction 119. That is according to the invention a method of controlling the pressure of vertical continuous comminuted cellulose fibrous material digester 100 having a lower treatment zone (e.g. counter current washing zone, or co-current wash zone, or a cooking zone, and may be the final treatment zone before discharge) adjacent screen 129 with at least one wash screen 129, a main extraction 104, a pressure-control extraction 118, 119, and at least one recirculation-dilution loop 103 distinct from the main extraction 104, the pressure-control extraction 118, 119, and the lower treatment zone, is provided. The method comprises: (a) controlling the pressure in the digester 100 primarily by varying the flow rate of liquor extracted from the pressure-control extraction 119 (by automatically controlling the valve 120 using the at least one pressure sensor 121 to maintain the pressure at a desired level within the range of 100–170 psi gage) to maintain the pressure in the digester 100 at a desired superatmospheric level while avoiding non-uniform, unstable material movement in the lower treatment zone. The method may also comprise (b) introducing dilution liquor into the digester 100 at the at least one recirculation-dilution loop 103 (that is at 113). The recirculation-dilution loop 103 may also have another separate extraction. As seen in FIG. 7, the pressure-control extraction 118, 119 is substantially the upper extraction in the digester 100 and (a) is then practiced above or before the main extraction 104 and above or before the at least one recirculation-dilution loop 103. The extracted liquor at 118, 119 preferably has an EA less than 15 g/l as NaOH, more preferably less than 10 g/l, and is before the chips or other cellulose material is exposed to cooking temperatures, i.e. preferably before it is exposed to a 130° C. temperature (or at least before it is exposed to a 150° C. temperature).

As a result, according to this invention, the variation in flow of liquor from the vessel 100 is located in a zone of the digester 100 that introduces less interference to the uniform flow through and treatment of material in the vessel 100. That is, flow variations are not introduced to the more sensitive zones, particularly the zone between screens 131 and 129 where the cellulose mass (that is, the "chip column") is softer. The uniform movement and distribution of chemical in such zones are more sensitive to interference from the introduction or removal of liquor. Though according to this aspect of the invention the pressure in the vessel is primarily, or even substantially exclusively, controlled by valve 120, e.g. operated automatically in response to pressure sensor 121, it is understood that excessive over-pressure or under-pressure may be accommodated by intermittent opening or closing of valves 117, 123, 126 or 127, individually or in combination.

It will thus be seen that according to the present invention various methods have been provided which increase the efficiency of kraft cooking, particularly in continuous digesters. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and processes.

What is claimed is:

1. A method of controlling the pressure of a vertical continuous comminuted cellulosic fibrous material digester having at least one treatment zone, a main extraction, and a pressure-control extraction, comprising:

(a) controlling the pressure in the digester primarily by varying the flow rate of extracted liquor from the pressure-control extraction.

2. A method as recited in claim 1 wherein (a) is practiced by substantially exclusively varying the flow rate of liquor extracted from the pressure-control extraction.

3. A method as recited in claim 2 wherein substantially only during excessive over pressure and under pressure conditions (a) is also practiced by controlling the rate of dilution into the at least one recirculation-dilution loop, and the extraction from the main extraction.

4. A method as recited in claim 2 wherein substantially except during excessive over pressure and under pressure conditions the extraction flow from the main extraction is maintained substantially constant.

5. A method as recited in claim 2 wherein (a) is practiced by controlling the amount of flow through a flow control valve, and to control the pressure in the digester to be at a predetermined level within the range of 130–170 psi gage, and by automatically controlling the flow control valve in response to pressure sensed by at least one pressure sensor.

6. A method as recited in claim 1 wherein (a) is practiced by controlling the amount of flow through a flow control valve.

7. A method as recited in claim 6 wherein (a) is practiced by automatically controlling the flow control valve in response to pressure sensed by at least one pressure sensor.

8. A method as recited in claim 1 wherein (a) is practiced to control the pressure in the digester to be at a desired level within the range of 130–170 psi gage, to maintain the pressure in the digester at a desired superatmospheric level while avoiding nonuniform, unstable material and liquid movement in the treatment zone.

9. A method as recited in claim 1 wherein the digester has at least one recirculation-dilution loop; and further comprising (b) introducing dilution liquor into the digester at the at least one recirculation-dilution loop.

10. A method as recited in claim 9 wherein (b) is practiced by introducing at least one of cold blow filtrate and washer filtrate as dilution liquor.

11. A method as recited in claim 1 wherein the pressure-control extraction is substantially the upper extraction of the digester, and wherein (a) is practiced above or before the main extraction, and above or before the at least one treatment zone.

12. A method as recited in claim 11 wherein (a) is practiced at a zone before the cellulose material has been exposed to a temperature of 150° C. or above.

13. A method as recited in claim 12 wherein (a) is practiced to withdraw liquor having an EA of less than 15 g/l expressed as NaOH.

14. A method as recited in claim 11 wherein (a) is practiced at a zone before the cellulose material has been exposed to a temperature of 140° C. or above.

15. A method as recited in claim 11 wherein (a) is practiced to withdraw liquor having an EA of less than 10 g/l expressed as NaOH.

16. A method as recited in claim 1 wherein (a) is practiced at a zone before the cellulose material has been exposed to a temperature of 140° C. or above.

17. A method as recited in claim 1 wherein (a) is practiced to withdraw liquor having an EA of less than 10 g/l expressed as NaOH.

18. A method as recited in claim 17 wherein (a) is practiced at a zone before the cellulose material has been exposed to a temperature of 140° C. or above.

19. A method of controlling the pressure of a vertical continuous comminuted cellulose material digester having a counter-current washing zone with wash screens, a main extraction, and at least one extraction-dilution loop distinct from the main extraction and the counter-current washing zone, comprising:

(a) extracting liquor from and introducing liquor into the digester at the at least one extraction dilution loop to maintain the pressure in the digester at a desired superatmospheric level while avoiding non-uniform, unstable movement in the counter-current washing zone.

20. A method as recited in claim 19 wherein the extraction-dilution loop includes a first screen assembly and a second screen assembly, below the first screen assembly, and wherein (a) is practiced so that the flow of extracted liquor from the first screen assembly is varied to maintain the pressure at the desired level.

* * * * *